US010753116B1

(12) United States Patent
Heath

(10) Patent No.: US 10,753,116 B1
(45) Date of Patent: Aug. 25, 2020

(54) GRAVESIDE PEDESTAL, SYSTEM AND METHOD OF DISPLAYING HEADSTONES

(71) Applicant: Alexis G. Heath, Jonesboro, GA (US)

(72) Inventor: Alexis G. Heath, Jonesboro, GA (US)

( * ) Notice: Subject to any disclaimer, the term of this patent is extended or adjusted under 35 U.S.C. 154(b) by 0 days.

(21) Appl. No.: 16/504,975

(22) Filed: Jul. 8, 2019

(51) Int. Cl.
*E04H 13/00* (2006.01)

(52) U.S. Cl.
CPC ..... *E04H 13/003* (2013.01); *E04H 13/00* (2013.01)

(58) Field of Classification Search
CPC ..... E04H 13/003; E04H 13/006; E04H 13/00
See application file for complete search history.

(56) References Cited

U.S. PATENT DOCUMENTS 833,212 A * 10/1906 Howard ..... E04H 13/003 52/38
1,860,915 A * 5/1932 Whitman ..... E04H 13/003 40/124.5
5,517,790 A * 5/1996 Jennings ..... E04H 13/003 47/79
5,517,791 A * 5/1996 Weiss ..... A61G 17/08 40/124.5
5,546,710 A * 8/1996 Barry ..... E04H 13/003 52/104
5,595,029 A * 1/1997 Revoir ..... E04H 13/003 40/124.5
6,006,458 A * 12/1999 Weiss ..... A61G 17/08 40/124.5
6,132,054 A * 10/2000 Rogers ..... E04H 13/003 362/145
2006/0123714 A1* 6/2006 Sannipoli, Sr. ..... E04H 13/003 52/103
2008/0034648 A1* 2/2008 Rasmussen ..... E04H 13/003 47/41.1
2009/0044462 A1* 2/2009 Myers ..... E04H 13/003 52/103
2009/0229195 A1* 9/2009 Murphy ..... E04H 13/003 52/103
2011/0094168 A1* 4/2011 Hill ..... E04H 13/003 52/103
2012/0079777 A1* 4/2012 DeArmond, Jr. ..... E04H 13/003 52/103
2013/0031850 A1* 2/2013 Dickinson ..... E04H 13/003 52/103

FOREIGN PATENT DOCUMENTS

CA 2820724 A1 * 1/2015 ..... E04H 13/003
FR 2827623 A1 * 1/2003 ..... E04H 13/003
FR 2847023 A1 * 5/2004 ..... E04H 13/003
GB 2052590 A * 1/1981 ..... E04H 13/003

* cited by examiner

*Primary Examiner* — Babajide A Demuren
(74) *Attorney, Agent, or Firm* — Silver Legal LLC; Jarrett Silver

(57) ABSTRACT

Pedestals, pedestal systems, and methods of mounting a slab on a pedestal are described herein. The pedestals have a slab placement surface containing a vase assembly receiving area that can safely support and display a slab combined with protruding vase cup. The vase cup protrudes through a mounted slab into the vase assembly receiving area and does not interfere with the slab sitting against the slab placement surface of the pedestal.

26 Claims, 6 Drawing Sheets

GRAVESIDE PEDESTAL, SYSTEM AND METHOD OF DISPLAYING HEADSTONES

TECHNICAL FIELD

The present disclosure relates to fixtures and methods of displaying grave markers in cemeteries and other ceremonies.

BACKGROUND

Headstones, also known as grave markers, are large slabs placed over graves and prepurchased plots. "Pre-need headstones," as they are known in the industry, are headstones purchased with one or more plots (also known as spaces) prior to the death of loved one(s). The headstone(s) are ordered, installed and remain in place, potentially for years before the purchased space becomes ready for occupancy. For the covered plot to be opened, the pre-need headstone must be temporarily removed.

Many headstones have a vase for flowers and have bronze plaque(s) mounted on a granite slab to identify the deceased in a particular space within cemeteries. The vase may be mounted within or outside of the plaque. A bronze plaque may contain names, birth and death dates, and epitaph messages.

Because of the heavy equipment in use around cemetery grounds such as backhoes or other reasons such as weather events, vases occasionally need to be inverted or turned upside down and placed in buried vase cups to protect the vases. Attached to and penetrating through many headstones is a vase and vase cup (together a "vase assembly"). The vase cup is the portion that goes through slab and protrudes through the bottom of the slab into the ground. Some vase cups are located directly within the slab fixed with a vase ring while others are located in the slab-plaque cross section, shortening the protrusion distance into the ground by around 1-2 inches. The plastic vase cups of a commonly used vase assemblies are 9-12 inches deep and 5 inches in diameter and protrudes through the slab into the ground by about 4-8 inches.

This protruding portion of the vase cup makes placement of the headstone on the ground complicated. Headstones, when unearthed and out of the ground, are placed on anything the cemetery operations staff can find. Headstones are often placed on cinder blocks, wood, and milk crates to support the unearthed headstone.

SUMMARY

Applicant does not appreciate that the most common structure upon which to place unearthed headstone is a plastic milk crate. Such crates, in Applicant's opinion, are an unsightly backdrop for funeral ceremonies and inappropriate holder of expensive grave markers for loved ones. Applicant has conceived of a new way of holding, displaying and mounting headstones containing vase cups that enables headstones to be made a central part of funeral ceremonies instead of being an eyesore in the background.

An example embodiment is a graveside pedestal for displaying a headstone slab. The pedestal is configured for securely holding and supporting the weight of a slab above the ground. The pedestal includes a slab receiving area arranged on a support; the slab receiving area including a slab placement surface for flushly supporting a back side of the slab, a slab seat surface for supporting a bottom side of a slab, and a vase assembly receiving area within the slab placement surface for receiving a vase cup that protrudes through both the slab and the slab placement surface when the slab is mounted on the pedestal. The slab placement surface is longer than and joined at a transverse angle to the slab seat surface. The slab placement surface is planar and disposed at an incline angle of at least 30 degrees relative to the ground and maintaining a center of gravity of the slab over the slab placement surface.

This pedestal embodiment can have many variations in its structure. A variation of the pedestal includes the slab seat surface being angled upward from the joint relative to the ground. Other variations have the transverse angle between 60 and 135 degrees or being approximately a right angle. A different variation is a width of the slab placement surface spans a width of the pedestal, and the height of the pedestal is at least two times the width of the slab placement surface. In another variation, the slab seat surface protrudes out at most 6 inches from the joint with the slab placement surface and holds the slab at least 3 inches above the ground. Another embodiment has the incline angle relative to the ground is between 45 and 80 degrees. A different variation is the vase assembly receiving area being the only opening in the slab placement surface sized to receive the vase cup through the slab placement surface. Another variation is the slab placement surface being planar and uninterrupted across its width except for the vase assembly receiving area.

This embodiment has variations in covering material and design. In another variation, a pedestal covering material covers at least the slab placement surface of the pedestal and has a textured or a tacky surface to minimize slipping of the slab. One option for the pedestal covering material is an artificial turf. In another variation, the pedestal covering material covers all visible portions of the graveside pedestal. Another variation has the vase assembly receiving area enclosed with flaps that remain visually closed when the slab is unmounted.

This embodiment has variations in the vase assembly receiving area's characteristics. The vase assembly receiving area may be defined by at least one of a hole, recess or receptacle in the slab placement surface. In a different variation, the vase assembly receiving area's vertical center point is above the vertical center point of the slab placement surface. A different variation has the vase assembly receiving area's maximum width at least 4 inches and at most 7 inches and the vase assembly receiving area's maximum height greater than its maximum width. Another variation is the vase assembly receiving area's maximum width one-half to one-third of the pedestal's width.

This embodiment can have variations outside of the slab placement area. In one variation, an alignment of the vase assembly receiving area with the vase cup can be viewed from behind the pedestal through an opening or a removable panel. In another variation, the pedestal may include a surface proximate to the top of the slab placement surface and parallel to the ground and sized to support at least a base of a multi-flower arrangement.

A graveside pedestal system embodiment is also described herein including a headstone mounted on a pedestal. The pedestal can be any of the previous mentioned pedestals or a different one. The headstone includes a slab, a vase hole and a vase assembly including a vase connected to a vase cup, the vase cup disposed through the vase hole protruding out beyond the slab on the non-vase side. The pedestal is configured for securely holding and supporting the weight of the headstone at an incline above the ground. The pedestal includes a slab placement surface and a slab seat surface joined at a transverse angle and arranged on a support and a vase assembly receiving area wholly disposed within the slab placement surface. The vase cup in the slab penetrates through the vase assembly receiving area into the interior of the pedestal. The slab placement surface of the pedestal flushly supports the mounted slab. An optionally variation is with flowers disposed on the pedestal. Another option where the center of gravity of the slab is over the slab placement surface due to the incline.

Also described herein is an arrangement of at least two graveside pedestals for holding a single slab.

A method of mounting a slab on a graveside pedestal embodiment is described. The method includes the steps of suspending a slab over a pedestal, aligning the slab over the pedestal, and lowering the slab on the pedestal. In further detail, the pedestal includes a slab placement surface joined to a slab seat surface and a vase assembly receiving area wholly disposed within the slab placement surface. The slab is aligned so that a vase cup protruding through the slab matches with the vase assembly receiving area. The slab is lowered onto the pedestal until the aligned vase cup protrudes through the vase receiving area beyond the slab placement surface, the slab placement surface flushly supports the slab at an incline to the ground, and the slab seat surface supports the slab. Optional steps include a step of extracting the slab from the ground and a step of placing a flower arrangement on or next to the pedestal.

Each of the above variations can be additional or alternative to other variations and used across embodiments, even if not claimed as such at present. There has thus been outlined, rather broadly, some features of the pedestals, pedestal systems and methods so the detailed description thereof may be better understood, and so the present contributions to the art may be better appreciated. There are additional features of the pedestals, pedestal systems, and methods described and that will form the subject matter of the claims appended hereto. In this respect, before explaining at least one embodiment of the pedestals in detail, it is to be understood that these things are not limited in its application to the details of construction or to the arrangements of the components in the following description or illustrated in the drawings.

BRIEF DESCRIPTION OF THE DRAWINGS

The Figures are incorporated in and constitute a part of this specification. These illustrative examples, together with the description, serve to explain the principles. Similar items will not necessarily be re-referenced or referenced with a different reference numeral across the Figures unless doing so benefits a point that Applicant desires to illustrate.

DETAILED DESCRIPTION

Despite ritual-focused cemeteries having experienced little innovation over the past several centuries, Applicant has conceived of and described herein inventive pedestals, pedestal systems and methods related to displaying headstones such as pre-need headstones for committal services or ceremonies. Common US headstone slab sizes include, among other sizes, 62" ("=inches)×16", 60"×20", 48"×18", 40"×16", 20"×28", 28"×18", 28"×16", 34"×34", and 34"×38". A common slab depth is 4 inches. These headstones are typically made of hard stone like granite and meant to outlast the elements. As a result, they are extremely heavy. Headstones commonly weigh 80 to 400 pounds. Because the slabs are so heavy and the plastic vase cups are breakable if mishandled, care must be taken to provide pedestals that support the slab appropriately and a method of loading the slab onto the pedestals.

Figure 1:
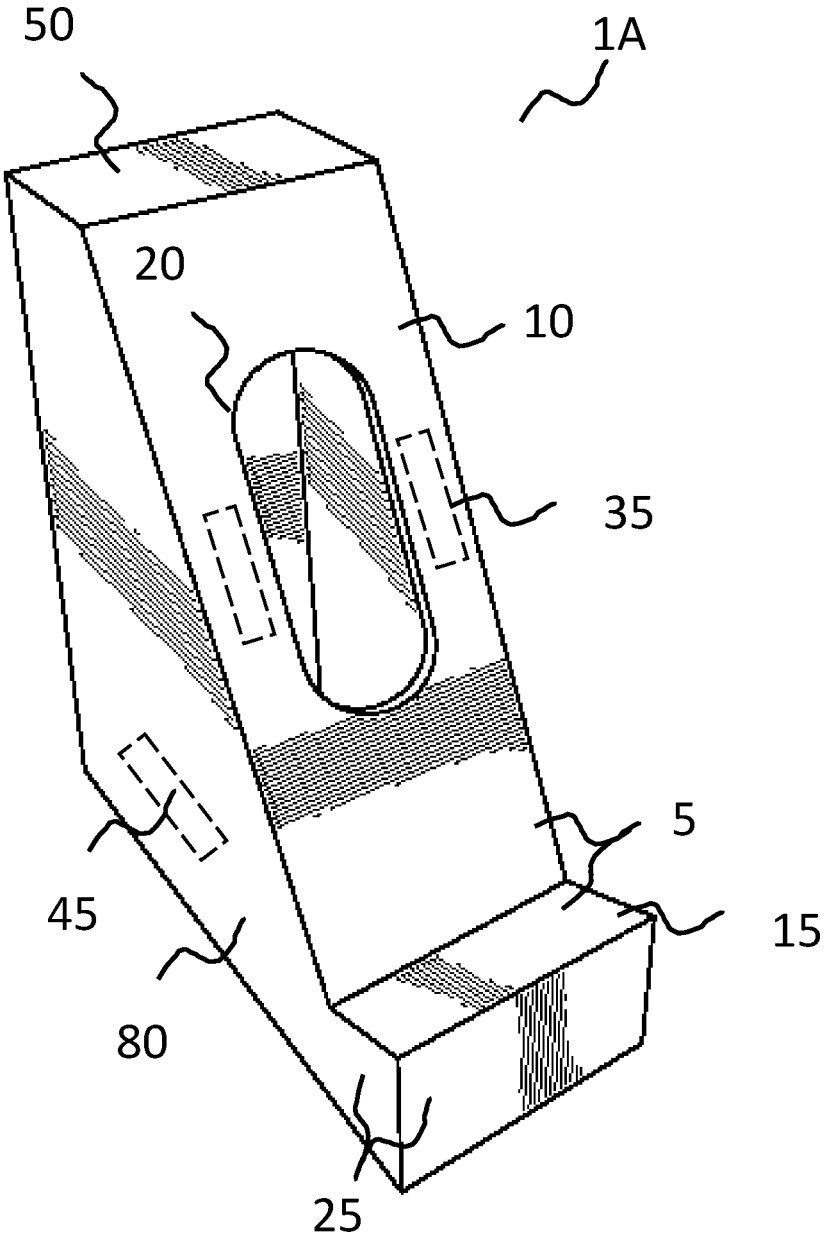
FIG. 1 is a perspective view showing an exemplary first embodiment of a pedestal.

FIG. 1 is an exemplary embodiment of a pedestal 1A designed for holding and displaying a mounted headstone (not shown). The pedestal contains a slab receiving area 5 sitting atop a support 25. The slab receiving area 5 includes a slab placement surface 10, a slab seat surface 15 and a vase assembly receiving area 20. In some embodiments, the support 25 includes front lower panel, side panels and optionally a back panel 65, a crossbeam support 45, and/or a bottom panel connecting the side panels (not shown). An optional surface 50 can hold flower arrangements and/or provide more depth within the vase assembly receiving area 10 of the pedestal to allow for longer vase cups. Here, the flowers can accent the headstone without materially obstructing the viewer's view of the headstone's plaques or inscriptions. Such surface 50 can be above (pictured in FIG. 1 and covered in flowers 145 in FIG. 4) or below the slab receiving area 5.

Slab placement surface 10 contains a vase assembly receiving area 20 that can accept the protruding portion of a vase cup without materially interrupting the slab from sitting flush against the slab placement surface 10. The slab placement surface 10 sits at an inclined placement angle of at least 30 degrees and less than 90 degrees relative to ground. A narrower range for the incline angle may be 40 to 80 degrees, and even more narrowly, 45-65 degrees. The incline angle is transverse to the zenith, the vertical line perpendicular (90 degrees) to the ground, so that the slab inclines backward from the viewer. The slab incline angle can be low enough that the center of gravity of the slab comfortably rests behind the joint over the slab placement surface and high enough that the viewer can comfortably view the slab and read the plaques from a sitting or a standing position.

Example sizes of the slab placement surface, in terms of exposed panel dimensions from the joint with the slab seat surface to the top of the pedestal, include 30 inches by 12 inches, 35 inches by 12 inches, and 40 inches by 18 inches (panel height by width). An example size of the vase assembly receiving area are two-thirds (⅔) of the exposed portion of the slab placement surface by 6 inches (maximum height by maximum width). This size can be smaller provided it is large enough to receive a vase cup. An example incline angle is 53 degrees. An example slab seat surface has 4 inches (exposed) between the joint and the front of the pedestal. An example angle of the joint between the slab placement surface and the slab seat surface is 90 degrees.

Figure 4:
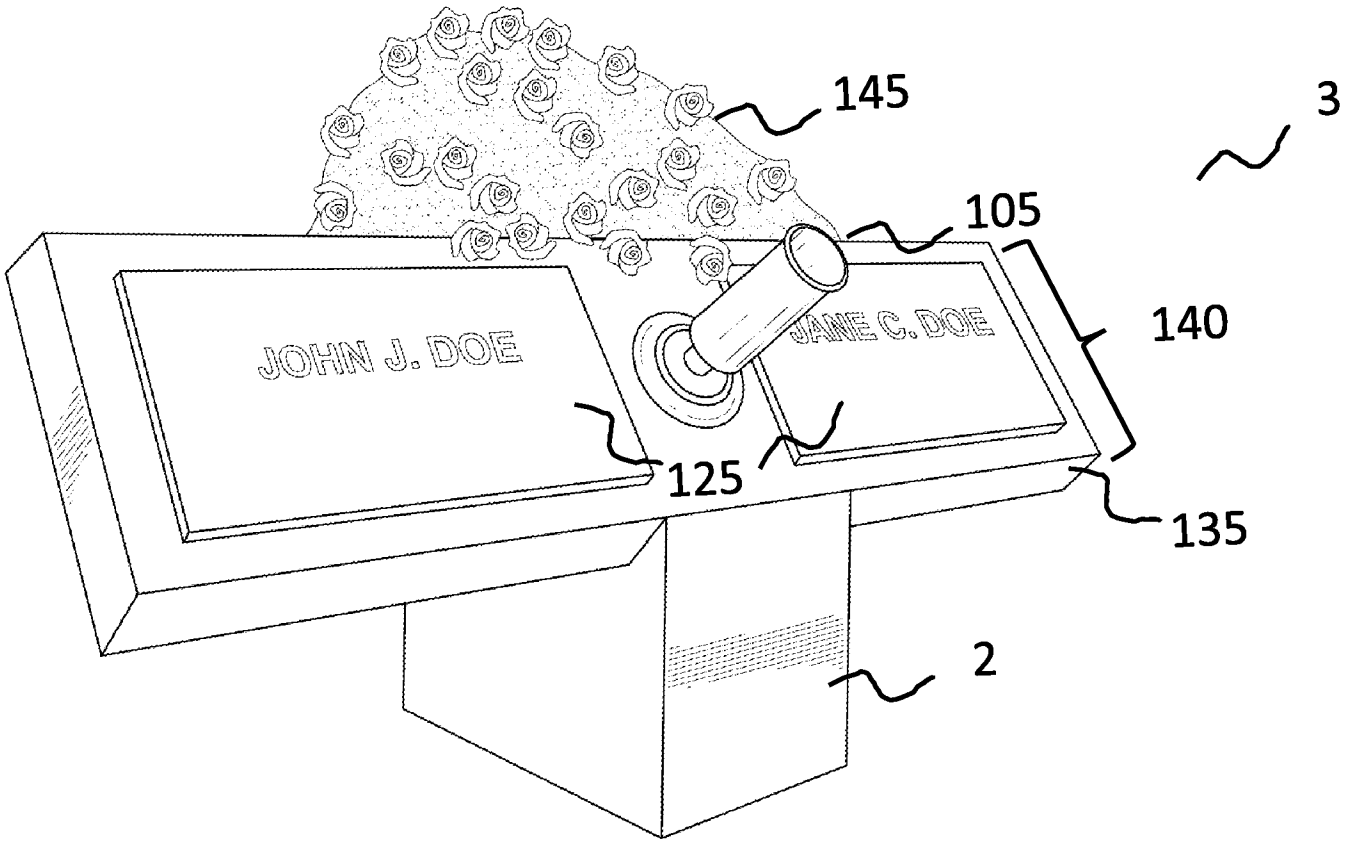
FIG. 4 is a perspective view of an exemplary embodiment of a pedestal system that includes a pedestal mounted with a headstone with a vase and a flower arrangement.

As illustrated in FIG. 4 with a different pedestal embodiment, the placement angle holds the slab 135 at a comfortable viewing position on the slab placement surface (not visible) of pedestal 2 while the center of gravity and weight of the slab 135 remains securely over the support.

The slab seat surface 15 operates to hold the received slab in place on the slab placement surface 10 and is directly or indirectly upheld by the support structure underneath the slab placement area 5. 4 inches exposed depth of the slab seat surface 15, defined as the part extending from the slab placement surface 10, holds most standard sized headstones with a depth of about 4 inches, but the slab seat surface depth or the slab depth can vary. A slab seat surface 15 depth of at least 2 inches (or at least half of the slab's depth) may function to hold a slab provided the angle, size and friction of the slab placement surface 10 ensure the slab placement surface 10 is carrying most of the weight of the slab and not putting the viewer at risk of a falling slab.

Figure 2:
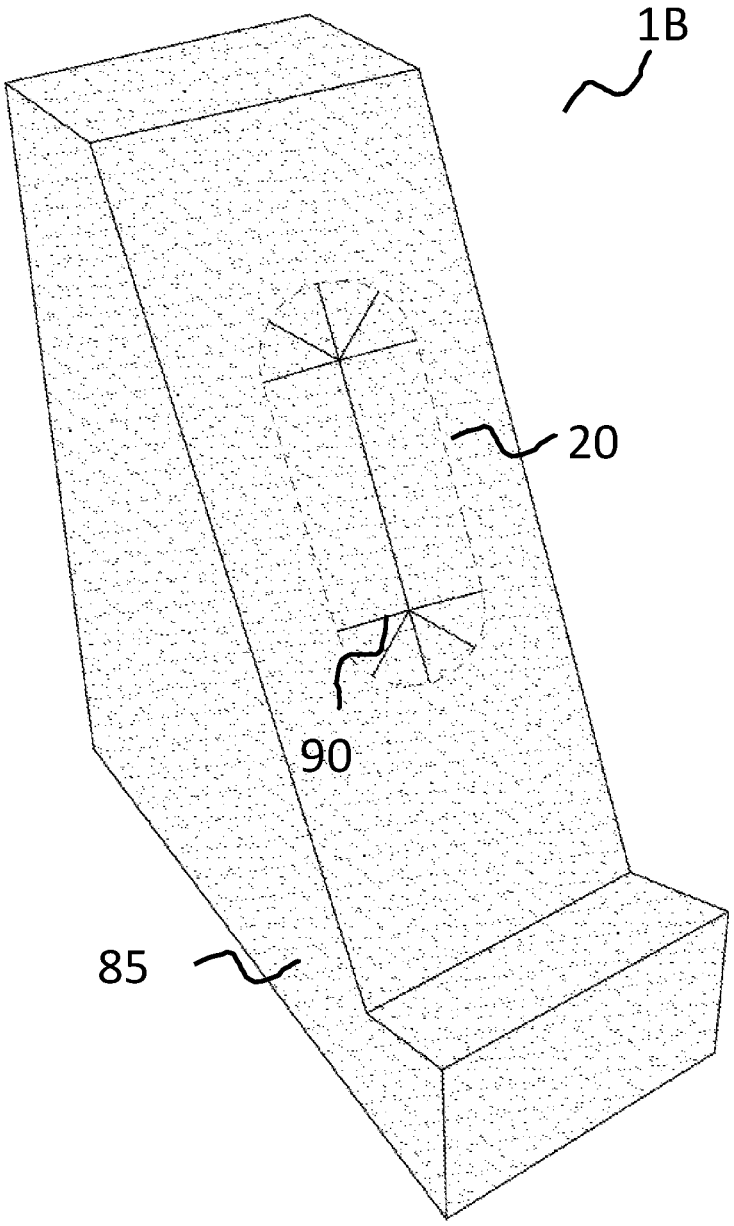
FIG. 2 is a perspective view of an exemplary second embodiment of pedestal, which is like the embodiment of FIG. 1 but with an additional covering material.
Figure 3:
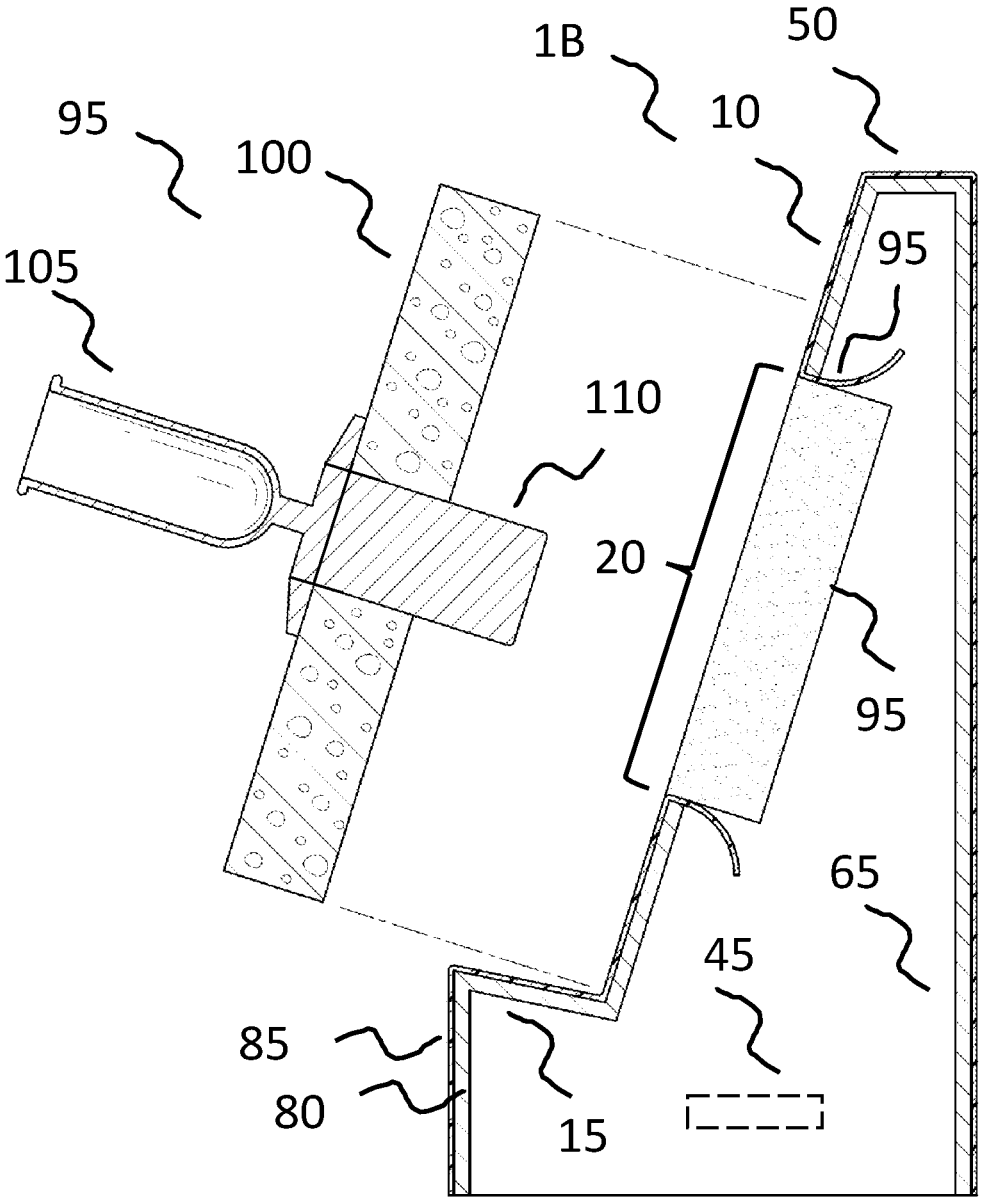
FIG. 3 is a cross-sectional view of the second embodiment of the pedestal with the cross section bisecting the pedestal.

FIGS. 2 and 3 illustrate the plywood 85 embodiment of pedestal 1A in FIG. 1 with a covering 90, identified as pedestal 1B. FIG. 2 is a perspective view of pedestal 1B whereas FIG. 3 is an exploded cross-sectional view of a headstone 95 mounted on pedestal 1B.

A covering 85 in pedestal 1B (shown in FIGS. 2 and 3) can provide both movement resistance (friction) and cushioning to the headstone while also providing a decorative or ornamental covering to the mechanical structure of the pedestal. A material that Applicant uses for the covering 85 is green waterproof artificial turf. The green color and soft appearance of the turf helps the pedestal blend in with the green surrounding grass and trees at the cemetery and highlight the stark contrast of a granite headstone. Rubber matting and compressible and tacky material layers such as polymers/putty/leather could also work as the covering. Carpets and fabrics, while not typically providing the tackiness, when used as the covering material could still provide cosmetic improvements. The covering 85 may also cover the visible and non-visible panels of the pedestals 1B and 2 beyond the slab receiving area 5, as shown in FIG. 3.

It is conceivable that a cemetery might have unmounted pedestals visible. While not required, the vase assembly receiving area can be covered with closeable opening flaps 90, optionally of extra covering 85 or another material, as shown in FIG. 2. Optional opening flaps 90 have the benefit of hiding the opening of the vase assembly receiving area 20 when a pedestal is unmounted. The opening flaps 90 can also protect animals from occupying, dwelling or nesting in the pedestal.

FIG. 3 shows the opening flaps 90 in an opened position due to the mounting of headstone 95 in the exploded view. Additionally or alternatively to opening flaps, a receptacle (not shown) in the vase assembly receiving area 20 can cordon off the vase assembly receiving area from the rest of the pedestal and make the pedestal a less desirable place for animals or keeping people from accidentally sticking their heads in the vase assembly receiving area. A recess (not shown) can achieve similar results as a receptacle, provided it is deep enough to not interfere with the protruding portion of the vase cup.

The step of mounting the headstone on the pedestal while the protruding portion of the vase cup is accurately aligned with the vase assembly receiving area needs to be approached carefully. While this is possible with only visible confirmation from the front of the pedestal, the pedestal can have a viewing area in additional to the front of the pedestal. Alternatively, the pedestal may contain a sensor system 35 mounted near the vase assembly receiving area, as shown in FIG. 1, or inside of the top, back or bottom panels (not shown) to help the mounter know when alignment has been achieved.

Viewing the alignment from the back of the pedestal is one method of ensuring alignment. Not shown, the back panel 65 may be removeable or have a removeable portion allowing someone standing there to view and confirm alignment. Additionally or alternatively, the back panel may have an opening (not shown) for viewing or confirmation. For reasons similar to those discussed above or others, such opening in the back may have similar opening flaps to opening flaps 90 or another type of closure like a cabinet door.

Instead of or in addition to visual confirmation of alignment, optional sensors 35 and alert system (not shown) may notify the cemetery operations staff in charge of mounting the headstone of the present alignment. Alerting can be done by any normal alarm such as an light emitting diode ("LED") indication light that illuminates or turns off or an audible indicator that beeps when the protruding vase cup is aligned with the vase assembly receiving area. Appropriate sensors might be, among others, optical (laser scanning, transmittance or absorbance), mechanical actuation, magnetic, EMF induction current, or piezo electric. Sometimes, the vase cup might be wrapped in a metal or reflective or specialty tape to assist with the sensing. If opening flaps and/or receptacles are used, care must be taken to choose a sensor type and placement that does not conflict with these things or interfere with the sensor. Separate indicators may be triggrered when the protruding vase cup initially or fully enters the vase assembly receiving area, and these may communicate wired to a local received or wirelessly with a remote receiver in the backhoe or elsewhere. Off-the-shelf sensor systems and circuits could be used or custom sensor/alerting systems with common computer components such as controllers, non-transient memory, storage, and a communications bus and/or wireless communications. With proper alignment sensed by and communicated from the sensors, it is possible to increase mounting accuracy and throughput, reduce the people required in the pedestal mounting operation or even automate using machines or robots to mount a pedestal. (Usually, two people and backhoe are utilized to handle the headstones around a cemetery.)

As the pedestals may be stored outside or used outside while raining or snowing, design choices should naturally follow the pedestal's intended usage. For example, for pedestals to be used outdoors, the pedestal covering should be a waterproof or water-resistant material. Any electronics should be appropriately shielded from foreseeable weather elements. The sensors may be mounted inside the pedestal or a receptacle in the vase assembly receiving area to protect them from the weather elements and accidental contact with the headstone or the protruding vase cup. All fasteners and exposed metals could be chosen to withstand the elements. Wood may be pressure treated to prevent reacting to moisture and humidity. Metal framing may undergo materials selection or additional processing to provide rust protection, acid rain, or air pollution protection.

The slab placement surface 10 connects to the slab seat surface 15 at a transverse angle to create the slab receiving area 5. The angle between the slab placement surface and the slab seat surface can be around ninety (90) degrees. Alternatively, this angle may be anywhere in the range of 50-135 degrees to accommodate different slab thicknesses, shapes, edge types, and mounting methods. For example, the angle can be greater than 90 degrees or the slab seat surface can be convex helping to use the slab seat surface 10 as a fulcrum to rock the headstone from a vertical position in place to the mounted position. The slab seat surface may even have an upward outer lip like a checkmark shape to prevent headstone movement from the front of the slab seat surface. Angles less than 90 degrees would help to keep slabs in place, particularly thinner ones, by the slab seat surface 15 applying pressure to the slab toward the slab placement surface 10. Decisions regarding the angle or the slab seat surface shape or the mounting method are interrelated with the amount of clearance needed in the design, the headstone dimensions and the vase cup protruding depth to get the vase cup 110 into the vase assembly receiving area 20 without undue pressure on the vase cup 110. Regardless of the transverse angle between the slab placement surface and the slab seat surface and the incline amount of the slab placement surface 10, the slab seat surface 15 may be angled upward so as not to be parallel to the ground.

As shown in FIG. 3, many headstones 95 contain a decorative cemetery vase 105 installed inside through a cut vase hole (not marked) in the slab 100. The visible portion of the vase 105, the flower holder, is part of a larger vase assembly extends into the headstone and protrudes out the other side. As mentioned above, the vase assembly includes a vase 105 on one side and a vase cup 110 on the other side. Of interest for this specification is the protruding portion of the vase cup 100 and the portion being received into the vase assembly receiving area 20. The upper most part of the flower holding cup could sit, for example, 10 inches above the slab. In most headstones that Applicant is familiar with, the protruding length of the vase cup 110 beyond the slab 100 is about 4 inches. The vase assembly may include other details such as rings, decorative touches or fixing mechanisms that are not critical for understanding Applicant's claims.

Figure 5:
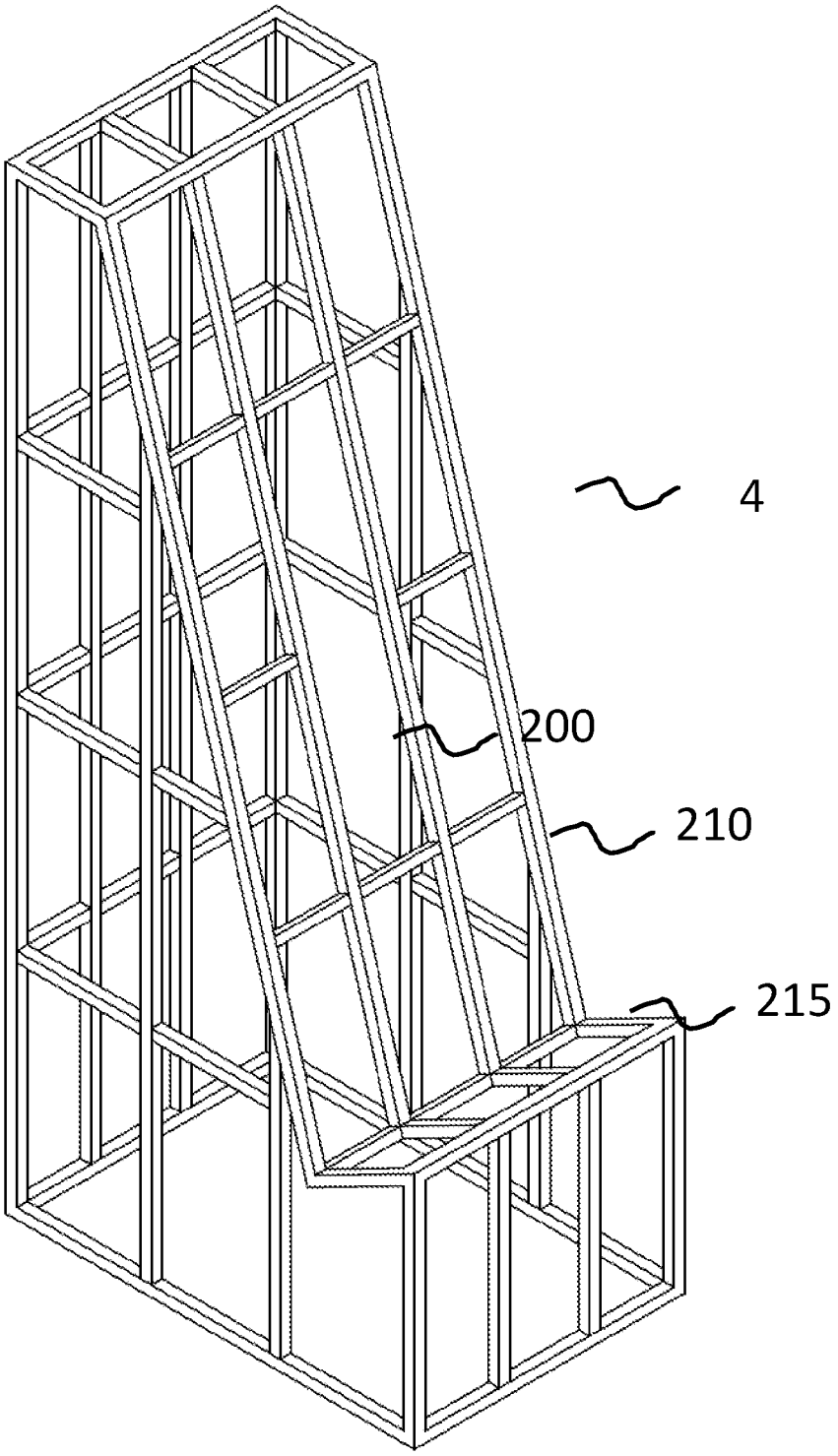
FIG. 5 is a perspective view of an exemplary third embodiment of a pedestal having a different construction than that of the first embodiment.

Applicant's pedestals can display a mounted headstone while a vase assembly receiving area receives the protruding portion of the vase cup. In this way, the headstone slab can sit flush and uninterrupted against the slab placement surface. Flushly supporting, as used in the claims, need not be perfectly flush or mean the slab placement surface needs to be as wide as the slab it is supporting. Imperfections in a planar surface or discontinuities can still be flushly supporting. FIG. 5 shows a surface constructed of a welded metal frame, and this surface can flushly support a headstone provided the vase cup is received fully by the vase assembly receiving area and the headstone slab makes materially complete contact with the rest of the outer surface or covering material designed for receiving the headstone slab. In other words, if the addition of a covering to the surface would flushly support a headstone slab, then the same surface would flushly support a headstone slab absent the covering. In contrast, a curved slab placement surface, or a slab placement surface without a vase assembly receiving area, would not be flushly supporting a flat-surfaced slab with a protruding vase cup. The vase assembly receiving area ensures that the protruding vase cup need not be removed or positionally adjusted to mount the slab against a flat surface. Nor does the vase cup receive the pressure of the slab or a flat resting surface or get damaged when the slab is mounted on the pedestal above the ground.

The pedestals benefit when they balance structural integrity and holding strength of the construction materials with design to be capable of displaying heavy slabs, while being light enough, when unmounted, to be capable of movement around the cemetery without heavy equipment. In addition, choosing lower material and manufacturing costs and easier-to-construct designs can lower the overall cost. Applicant's plywood 80 construction with optional covering 90 of the pedestals 1A, 18 and 2 embodiments can be built to be under 25 pounds in weight and have low manufacturing and materials costs relative to their utility.

At a minimum, the size, shape and location of the vase assembly receiving area 20 needs to be capable of receiving the protruding portion of the vase cup 110. The vase assembly receiving area could be sized to accommodate a single headstone's vase assembly placement or a range of headstone sizes and vase assembly positions within those headstones (extending a portion or the entire length of the slab placement surface). As most protruding vase cups are circular in shape and a few inches in diameter, the vase assembly receiving area 20 can be a round shape at least this big to receive such protruding vase cups. This shape of the vase assembly receiving area 20 can be vertically extended, such as shown in FIGS. 1 and 2, or horizontally extended (not shown), to fit a variety of protruding vase cup heights relative to each slab, and for different slab sizes. The vertical extension as shown compliments a narrow pedestal width, works at different heights and positions of protruding vase cups, and maintains as much structural integrity of the slab placement surface 10 as possible by minimizing the opening size of the vase assembly receiving area 10. A horizontal extension, in most scenarios, would be better fitted for a wider pedestal width to avoid an off-balance headstone mounted on a pedestal. In the FIG. 1 embodiment, the opening of the vase assembly receiving area 10 is approximately one-half of the width of the slab placement surface 10, and the overall pedestal 1A from that side. For example, if the width of the slab placement surface 10 is 12 inches, the opening of the vase assembly receiving area 10 might have a width of 6 inches on a narrow pedestal such as shown in FIG. 1. This opening could be ovular, or circular with a rectangle bisecting and inserted within the separated circle halves, preferably with the entire vase assembly receiving area 20 opening height accommodating at least the 5-inch diameter of common sized protruding vase cups 110 used in the cemetery industry. As an alternative, FIG. 5 illustrates in pedestal 4 that the shape of vase assembly receiving area 200 on slab placement surface 210 is a rectangle. Because many vases are located in the upper portion of headstones, it may be advantageous to locate the vertical center point of the vase assembly receiving area above the vertical center point of the slab placement surface (the exposed portion) to account for more upper-headstone located vase positions. One of ordinary skill in the art would appreciate that the vase assembly receiving area opening can be different sizes, shapes and positions and still accomplish the purpose of the claimed pedestals. Also, the slab placement surface 10 might have a different width than the pedestal in pedestals with different shaped cross sections. Additionally and alternatively, the width of the slab placement surface 10 may not match the width of the slab seat surface 15.

The slab placement surface 10 could be structurally reinforced (not shown) around or proximate the vase assembly receiving area 20 to compensate for any weaknesses introduced by the creation of the vase assembly receiving area 20 in the slab placement surface 10. Additionally or alternatively, the vase assembly receiving area 20 may include a receptacle (not shown) that is chosen to provide room for the protruding portion of the vase cup 110 while structurally reinforcing the opening with fasteners, such as with adhesive, screws and/or rivets.

The viewing position, for example, from a funeral service, maybe from a sitting or standing position, and therefore the slab receiving area 5 on differing pedestals or adjustable pedestals can display the headstone at different heights for different purposes, as illustrated by the different heights in of the pedestals respectively FIGS. 3 and 4. The shape and size of slab 135 in FIG. 4 is much wider than tall and also may look better when presented higher up. An adjustable height pedestal (not shown) might operate with a corkscrew and a crankshaft construction, enabling the cemetery operations staff to move the slab seat surface 15 up and down to adjust the headstone presentation height. One of ordinary skill in the art would appreciate that such a height adjustment mechanism can be replaced with other known manual or automatic height adjustment mechanisms that accomplish the same goals as the pedestals herein.

Prior to the introduction of Applicant's pedestals and pedestal systems, headstones were not intended to be a part of a funeral ceremony. Headstones were something temporarily set aside to access the graves. With these pedestals, the headstones may be part of a decorative centerpiece. Flower arrangement 145 can be placed on surface 50. Additionally or alternatively, a wreath or other decoration may be used here (not shown). In addition, the larger size of slab 135 against a thin pedestal 2 enables additional flower arrangements or wreaths (not shown) to be placed touching or proximate to the pedestal but behind the slab to enhance and not to interfere with the headstone's viewing.

Although pedestal differences have been discussed, FIG. 4 illustrates these components including headstone 140, pedestal 2 and optional flower arrangement 145 together as a pedestal system 3. One of ordinary skill in the art would appreciate the any parts of this system and can interchanged with the components of FIG. 3 or anything else discussed herein or their equivalents or understood to be within scope of a different embodiment of the pedestal system.

A person of ordinary skill in the art would understand that the pedestals may have different display heights, display angles, construction materials, and designs without affecting any of the underlying purposes of the pedestals.

FIG. 3 illustrates a mounted headstone containing a vase on a pedestal with a flower arrangement on the top panel. FIG. 3 shows how the top panel is used to hold a flower arrangement. The position of the headstone mounted in FIG. 3 is higher than a mounted headstone would be in FIGS. 1 and 2. This illustrates how different pedestal sizes and configurations can be used for different sized headstones or to intentionally present the headstones to the viewers at different eye positions such as a seated or a standing position.

Lateral cross support 45 extends across the width of the pedestal in FIGS. 1-3. This support 45 could take many forms, including a cutout/insert design, a tongue and groove design, or attached with screws with or without a cutout. A person of ordinary skill in the art would understand that various types of mechanical reinforcement such as braced frames, circumferential supports, material thickening or stiffening, counterbalancing, etc. can be used instead of the cross supports.

Exemplary materials for the embodiments of pedestals 1A and 1B and 2 in FIGS. 1-4 are five-ply plywood, nails, glue and green waterproof artificial turf such as AstroTurf. With this construction, the pedestal weight is around 20 pounds and relatively cheap to manufacture. The simplicity of the plywood construction means the pedestal could literally be manufactured on site at a cemetery. Other exemplary pedestals may be constructed of welded metal rods, as shown in FIG. 5 (discussed below), welded sheet metal, molded plastic, composites or other materials capable of carrying a structural load. One of ordinary skill in the art would understand that various materials, constructions, mechanisms of adhering or fastening pedestal components together, angles of slab incline, and pedestal sizes are possible and within the scope of the claims.

FIG. 5 shows an exemplary pedestal embodiment including a rigid skeletal frame structure of welded metal forming the pedestal. Similar to FIG. 1, FIG. 5 illustrates pedestal 4 having a slab placement surface 210, a slab seat surface 215 and vase assembly receiving area 200. While FIG. 5 shows vase assembly receiving area 200 at a specific location, one of ordinary skill in the art would understand that the vase assembly receiving area size and shape is customizable with the flexibility and strength that a welded metal structure provides. This embodiment, and the embodiment in FIGS. 1 and 3 and 5, can be enclosed in a visually pleasing and slip-resistant covering material as shown in FIG. 2. Green waterproof artificial turf can be the cover material and the opening flaps material.

The flower holding surface 50 may have additional features such as a hollowed out concave bowl area to help a flower arrangement bowl from accidentally getting knocked off the pedestal or a raised platform area to help accentuate a flower arrangement and its planter over larger headstones.

Using the embodiments herein, headstones mounted on pedestals can be an essential visual component of a committal service and would make it easier for a staged photo opportunity with loved ones with the headstone and the flower arrangements.

In addition to a visual component, headstones offer an auditory component of a committal service. Pedestals may house an internal or integrated speaker (not shown), located anywhere except the slab placement area. The speaker may be wired or wireless and connectable to an audio source or a remote microphone or audio source. In this way, speeches, music or recordings can be magnified or broadcasted during a service or a ceremony. In additional to committal services, it is conceivable these pedestals may be used outside of cemeteries such as near national monuments for memorial services and parades.

Figure 6:
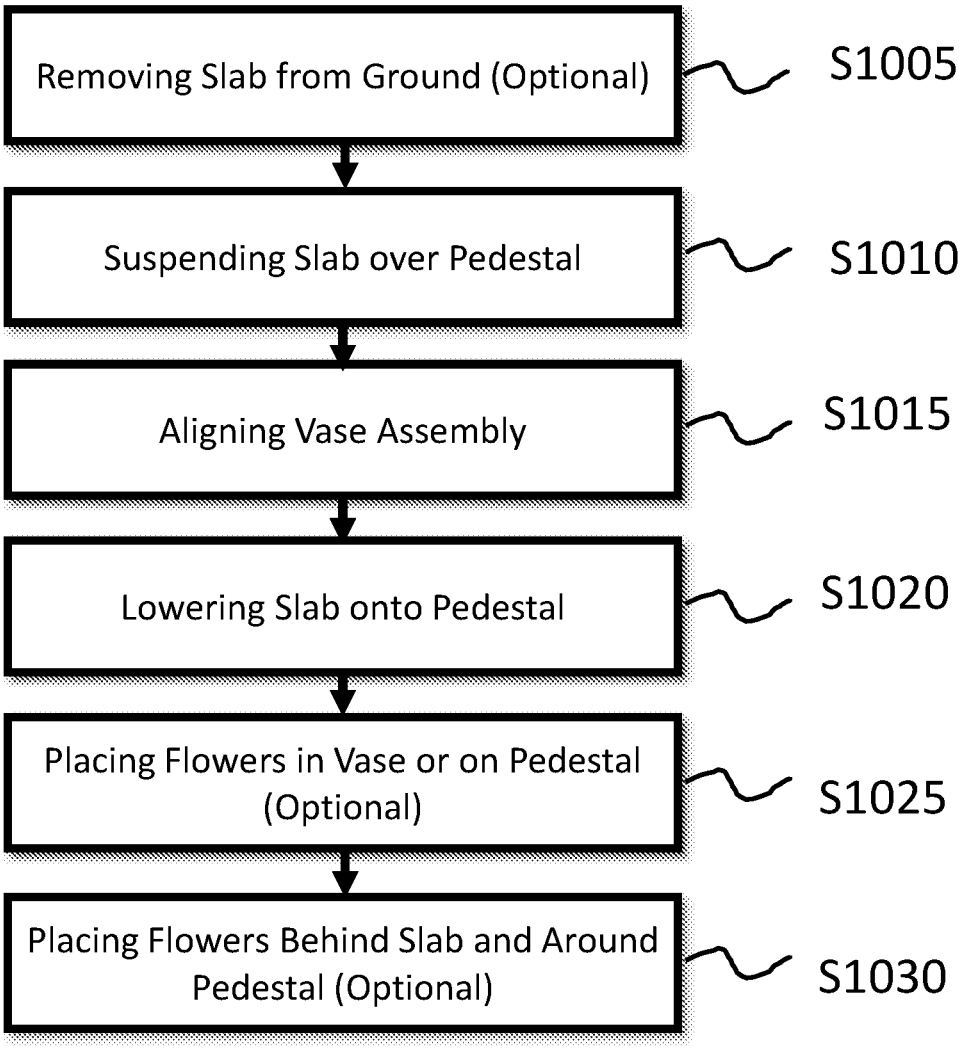
FIG. 6 is a flow chart of an exemplary method of mounting a headstone and optional flower arrangement on a pedestal.

FIG. 6 illustrates an exemplary method of mounting a headstone on a pedestal. In Step S1005, pre-need headstones are unearthed from the ground. Unearthing can be performed done by prying up and lifting the headstone with a shovel and then hoisting up with backhoe-connected straps, which have been slipped around the pried-up edges of the headstone. In Step S1010, the hoisted headstone is taken to and placed over a pedestal. The headstone may be suspended in midair while Step S1015 is performed, which is aligning and confirming the alignment of the protruding portion of the vase cup with the vase assembly receiving area. As discussed herein, alignment may be confirmed by visual inspection or sensed by a sensor or their equivalents. Optionally, in Step S1020, the headstone or the pedestal could be decorated with flowers in the vase or on top of the pedestal, or a wreath around the vase or on top of the pedestal or other decorations. Optionally, in Step 1025, additional flowers or other decorations can be placed on the ground or on stands near the pedestal. The method steps described herein are not necessarily performed in order unless required by the context. After the committal service has completed and the new grave site is filled, the headstone may be removed from the pedestal and returned to the ground, likely through similar use of heavy equipment.

In an example grave marker mounting embodiment, grave markers can be placed onto the pedestals using a backhoe and appropriate straps. The person or machine mounting the slab onto the pedestal first lines up the vase cup with the vase assembly receiving area. This automatically centers the grave marker assuming the vase assembly is placed on the central line of the grave marker and the vase assembly receiving area is in the center line of the pedestal. Once the holes are lined up, the grave marker can be placed on the pedestal. The angle of the slab placement surface ensures the that the mounted headstone's center of gravity is located over the slab placement surface so the headstone will not fall from the pedestal. The slab seat surface 5 is directly or indirectly supported by the support 25 so the slab seat surface 5 can hold a substantial portion of the weight of the slab when needed.

While the pedestal is designed to received vase cups, the same pedestal could be used for headstones without vase cups. The headstones without vase cups must me manually centered without the visual aid of confirming alignment with the vase assembly receiving area.

Some situations benefit from the simultaneous use of multiple pedestals. For example, if the slab size is wide or unwieldy, it may be better supported by two or more pedestals than an individual pedestal. Additional situation may occur where the vase assembly is in a position not along the center line of the slab. By using multiple pedestals, it would be possible to line up an off-centered vase assembly in a slab with a vase assembly receiving area on one pedestal and help support the same slab with another adjacent pedestal. Multiple pedestals may be used together with or without spatial gaps between.

The pedestals may be embodied in other specific forms without departing from the spirit or essential attributes thereof. It is intended that the specification, drawings and examples be considered as illustrative, exemplary and non-restrictive, with a true scope being indicated by the claims and their equivalents.

Numerous modifications, changes, variations, substitutions, and equivalents will occur to those skilled in the art without departing from the spirit and scope of claimed embodiments. It will be apparent to those skilled in the art that various modifications and variations can be made to the disclosed pedestals, pedestal systems and methods herein. These are intended to be included within the scope of the claimed subject matter.

Figure reference characters and lead lines are not exhaustive. Unlabeled parts may be claimed during prosecution and be within scope. Similar components may not be labeled across drawings.

Angular and positioning terms where a range is not given should be understood to have slight variation. For example, a "parallel" surface would still be considered parallel even if the thing it is parallel to is not exactly 180 or 360 degrees. In addition, a 5-degree change, as long as it doesn't change the function, would still fit within the meaning. For example, a right angle or a 90-degree angle would be understood to be anywhere form an 85- to a 95-degree angle.

Unless otherwise defined herein, all technical and scientific terms used herein have the same meaning as commonly understood by one of ordinary skill in the art to which the claims features belong. Moreover, Applicants inconsistent use of a term should not be construed as different terms unless defined by Applicant or the context. Any headings utilized within the description are for convenience only and have no legal or limiting effect. Regarding additional interpretation and construction of terms and steps herein, method steps are not in any specified order unless dictated by the context or specific wording. In addition, the use of a word in the singular form should be interpreted where the context allows or does not restrict to enable plurality or an "at least one" construction. Positional and directional terms described in this specification may be understood to differ from those shown or described and should not limit the variations of embodiments possible from the claimed features that a person of ordinary skill in the art would understand from the specification, Figures and claims. The term "and/or" in a list means all list items present, some list items present, or one of the list items present, unless such construction is limited by the context. Likewise, it is to be understood that the phraseology and terminology employed are for the description and should not be regarded as limiting.

The benefits, advantages, solutions to problems, and any element(s) that may cause any benefit, advantage, or solution to occur or become more pronounced are not to be construed as a critical, required, or essential features or elements of any or all of the claims unless indicated as such during prosecution. Other objects and advantages of the various embodiments and other embodiments will be apparent and/or become obvious to one of ordinary skill in the art from consideration of the specification and practice of the disclosed embodiments.

INDUSTRIAL APPLICABILITY

The pedestals, pedestal systems, and methods herein are useful for at least cemetery operations and processions and industries where similarly configured items may be held for display.

The invention claimed is:

1. A graveside pedestal for displaying a headstone slab, the pedestal comprising:

a pedestal configured for securely holding and supporting the weight of a slab above the ground, the pedestal including a slab receiving area arranged on a support;

the slab receiving area including a slab placement surface for flushly supporting a back side of the slab, a slab seat surface for supporting a bottom side of a slab, and a vase assembly receiving area within the slab placement surface for receiving a vase cup that protrudes through both the slab and the slab placement surface when the slab is mounted on the pedestal, the slab placement surface being longer than and joined at a transverse angle to the slab seat surface; and the slab placement surface being planar and disposed at an incline angle of at least 30 degrees relative to the ground and maintaining a center of gravity of the slab over the slab placement surface, wherein a pedestal covering material covers at least the slab placement surface of the pedestal and has a textured or a tacky surface to minimize slipping of the slab.

2. The graveside pedestal of claim 1, wherein the slab seat surface is angled upward from the joint relative to the ground.

3. The graveside pedestal of claim 1, wherein the transverse angle is between 60 and 135 degrees.

4. The graveside pedestal of claim 1, wherein the transverse angle is approximately a right angle.

5. The graveside pedestal of claim 1, wherein the vase assembly receiving area is enclosed with flaps that remain visually closed when the slab is unmounted.

6. The graveside pedestal of claim 1, wherein the vase assembly receiving area's maximum width is at least 4 inches and at most 7 inches and the vase assembly receiving area's maximum height is greater than its maximum width.

7. The graveside pedestal of claim 1, wherein the vase assembly receiving area's maximum width is one-half to one-third of the pedestal's width.

8. The graveside pedestal of claim 1, wherein the vase assembly receiving area is the only opening in the slab placement surface sized to receive the vase cup through the slab placement surface.

9. The graveside pedestal of claim 1, wherein, except for the vase assembly receiving area, the slab placement surface is planar and uninterrupted across its width.

10. The graveside pedestal of claim 1, wherein a width of the slab placement surface spans a width of the pedestal, and the height of the pedestal is at least two times the width of the slab placement surface.

11. The graveside pedestal of claim 1, wherein the slab seat surface protrudes out at most 6 inches from the joint with the slab placement surface and holds the slab at least 3 inches above the ground.

12. The graveside pedestal of claim 1, wherein the pedestal covering material is an artificial turf.

13. The graveside pedestal of claim 1, wherein the pedestal covering material covers all visible portions of the graveside pedestal.

14. The graveside pedestal of claim 1, wherein an alignment of the vase assembly receiving area with the vase cup can be viewed from behind the pedestal through an opening or a removable panel.

15. The graveside pedestal of claim 1, wherein the vase assembly receiving area is defined by at least one of a hole, recess or receptacle in the slab placement surface.

16. The graveside pedestal of claim 1, the pedestal comprising a surface proximate to the top of the slab placement surface and parallel to the ground and sized to support at least a base of a multi-flower arrangement.

17. The graveside pedestal of claim 1, the vase assembly receiving area's center point is above the vertical center point of the slab placement surface.

18. The graveside pedestal of claim 1, where the incline angle relative to the ground is between 45 and 80 degrees.

19. An arrangement of at least two graveside pedestals of claim 1 for holding a single slab.

20. A method of mounting a slab on a graveside pedestal, the method comprising the steps of:

suspending the slab over a pedestal, the pedestal including a slab placement surface joined to a slab seat surface and a vase assembly receiving area wholly disposed within the slab placement surface;

aligning a vase cup protruding through the slab with the vase assembly receiving area; and lowering the slab onto the pedestal until the aligned vase cup protrudes through the vase receiving area beyond the slab placement surface, the slab placement surface flushly supports the slab at an incline to the ground, and the slab seat surface supports the slab.

21. The method of claim 20, the method further comprising a step of extracting the slab from the ground.

22. The method of claim 20, the method further comprising a step of placing a flower arrangement on or next to the pedestal.

23. A graveside pedestal system, the system comprising:

a headstone mounted on a pedestal;

the headstone including a slab, a vase hole and a vase assembly including a vase connected to a vase cup, the vase cup disposed through the vase hole protruding out beyond the slab on the non-vase side; and the pedestal configured for securely holding and supporting the weight of the headstone at an incline above the ground, the pedestal including a slab placement surface and a slab seat surface joined at a transverse angle and arranged on a support and a vase assembly receiving area wholly disposed within the slab placement surface, wherein the vase cup penetrates through the vase assembly receiving area beneath the slab placement surface, and the slab placement surface flushly supports the slab.

24. The system of claim 23, wherein the pedestal system further comprises flowers disposed on the pedestal.

25. The system of claim 23, wherein a center of gravity of the slab is over the slab placement surface due to the incline.

26. A graveside pedestal for displaying a headstone slab, the pedestal comprising:

a pedestal configured for securely holding and supporting the weight of a slab above the ground, the pedestal including a slab receiving area arranged on a support;

the slab receiving area including a slab placement surface for flushly supporting a back side of the slab, a slab seat surface for supporting a bottom side of a slab, and a vase assembly receiving area within the slab placement surface for receiving a vase cup that protrudes through both the slab and the slab placement surface when the slab is mounted on the pedestal, the slab placement surface being longer than and joined at a transverse angle to the slab seat surface; and the slab placement surface being planar and disposed at an incline angle of at least 30 degrees relative to the ground and maintaining a center of gravity of the slab over the slab placement surface, wherein the vase assembly receiving area is enclosed with flaps that remain visually closed when the slab is unmounted.

* * * * *